United States Patent [19]

Delphin

[11] Patent Number: 4,856,836

[45] Date of Patent: Aug. 15, 1989

[54] SLING ASSEMBLY FOR USE WITH A CRANE

[75] Inventor: Joseph P. Delphin, Buras, La.

[73] Assignee: Conoco Inc., Ponca City, Okla.

[21] Appl. No.: 119,865

[22] Filed: Nov. 13, 1987

[51] Int. Cl.[4] ..... B66C 1/18

[52] U.S. Cl. ..... 294/74

[58] Field of Search ..... 294/31.2, 67.41, 74, 294/75, 81.55, 82.14, 137, 138, 149, 150, 154, 155, 157, 165, 170; 24/16 R, 16 PB, 17 A, 17 B, 17 AP, 18, 19, 30.5 L, 115 R, 115 A, 115 H, 115 K, 115 M, 127, 129 A, 130, 136 R, 136 L, 268, 270, 271

[56] References Cited

U.S. PATENT DOCUMENTS

| | | | |
|---|---|---|---|
| 620,519 | 2/1899 | Walsh | 294/74 |
| 1,063,738 | 6/1913 | Ruland | 294/74 |
| 1,218,714 | 3/1917 | Sunderland et al. | 294/74 |
| 1,446,278 | 2/1923 | Swenson | 294/74 |
| 2,080,148 | 5/1937 | Naysmith | 294/74 |
| 2,289,378 | 7/1942 | Moran | 294/74 |
| 2,814,521 | 11/1957 | Hughes | 294/74 |
| 3,343,862 | 9/1967 | Holmes | 294/74 |
| 3,362,744 | 1/1968 | Ek | 294/74 |
| 4,022,507 | 5/1977 | Marino | 294/74 |

FOREIGN PATENT DOCUMENTS

| | | | |
|---|---|---|---|
| 243675 | 11/1965 | Austria | 24/115 H |
| 1082746 | 3/1984 | U.S.S.R. | 294/74 |
| 559694 | 3/1944 | United Kingdom | 294/74 |
| 671413 | 5/1952 | United Kingdom | 294/74 |
| 733180 | 7/1955 | United Kingdom | 294/74 |
| 1067259 | 5/1967 | United Kingdom | 294/74 |

*Primary Examiner*—Johnny D. Cherry
*Attorney, Agent, or Firm*—Richard K. Thomson

[57] ABSTRACT

A sling assembly constructed of nylon fabric is useful in off-loading cargo to and from an offshore well platform, for example. Loops are formed in each fabric strap by passing one end through an eyelet formed in the other. A choker sleeve slides tightly behind each loop to enable the straps to be snugly positioned in contact with the article to be hoisted.

7 Claims, 2 Drawing Sheets

SLING ASSEMBLY FOR USE WITH A CRANE

BACKGROUND AND SUMMARY OF THE INVENTION

The present invention relates to the field of slings for lifting articles, and the like, with a hoist or crane. More particularly, the sling assembly of the present invention is designed to facilitate the lifgint of oil drums and other articles, onto and off of, an offshore platform, for example.

Heretofore, cable slings (generally used in pairs) with shackles, generally of a type depicted in U.S. Pat. Nos. 1,218,714 or 2,814,521 have been utilized to unload cargo from and to a supply vessel to and from an offshore platform such as one used for the production of hydrocarbon fluids from a subsea well.

These sligns with shackles essentially necessitate that a single workman perform three functions at once: (1) loop and fasten the cable slings around the article or articles to be lifted; (2) hook the lift ring to the hoisting hook on the crane; and, (3) maintain tension on the cable until the hoisint hook takes up the slack and starts lifting the article(s) so that the slings do not slide down the article and create an unbalanced lifting condition. Keeping hold of the slings until lifting has begun can put the workman in jeopardy not only from pinching by the cable slings but, also, from the load itself which can swing unpreditably, particularly if the supply boat is being buffeted by wind and waves. With use, the wire rope which makes up the cable slings has a tendency to fray which can further increase the risk of injury to the workman, both from the possibility of breakage and from coming into contact with the potentially puncturing wire rope.

The sling assembly of the present invention overcomes these difficulties. This sling is comprised of two straps of a high strength fabric cloth, preferably nylon. Each strap is formed into a loop by forming an eyelet in a first end and passing the second end through the eyelet. Each such second end is then attached to a ring by which the sling assembly can be connected to a hoisting hook. A tight-fitting sleeve can be slid along the strap behind the eyelet so that after the sling is placed around an article, it may be maintained in engagement by sliding the sleeve into contact with the eyelet. In this manner, the sling can be placed in gripping engagement with the article to be lifted and the workman can be clear from the area before the hoisting hook takes any load. Further, the high-strength cloth does not form puncture producing loose ends when fraying occurs and, because of its increased flexibility, does not fray as early in it wear life.

Various other features, characteristics and advantages of the present invention will become apparent after a reading of the following description.

BRIEF DESCRIPTION OF THE DRAWINGS

FIG. 1 is a schematic side elevation of the sling assembly of the present invention as it would be configured just prior to the hoisting of an oil drum, or the like.

DETAILED DESCRIPTION OF THE PREFERRED EMBODIMENT(S)

Figure 1:
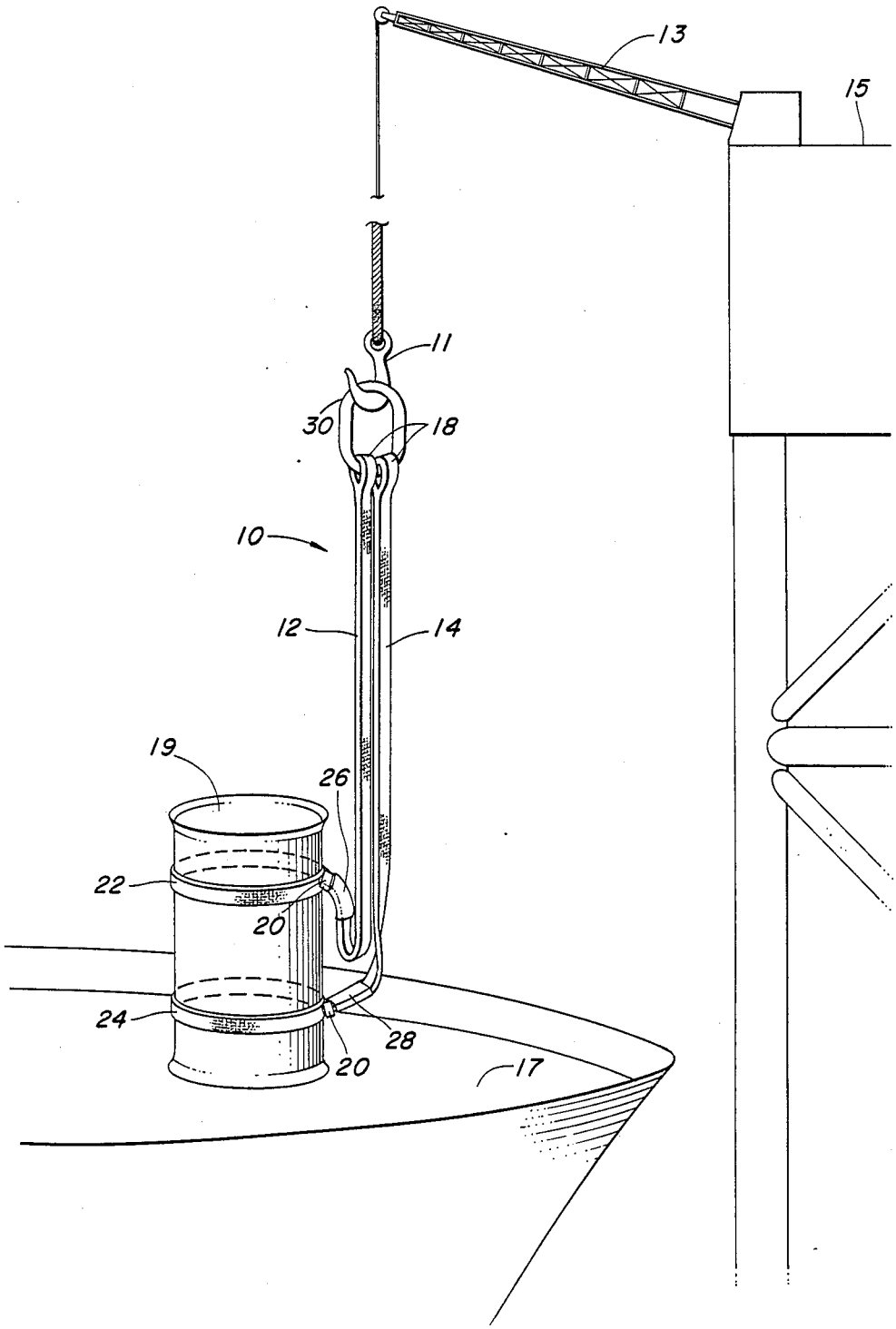
Figure 2:
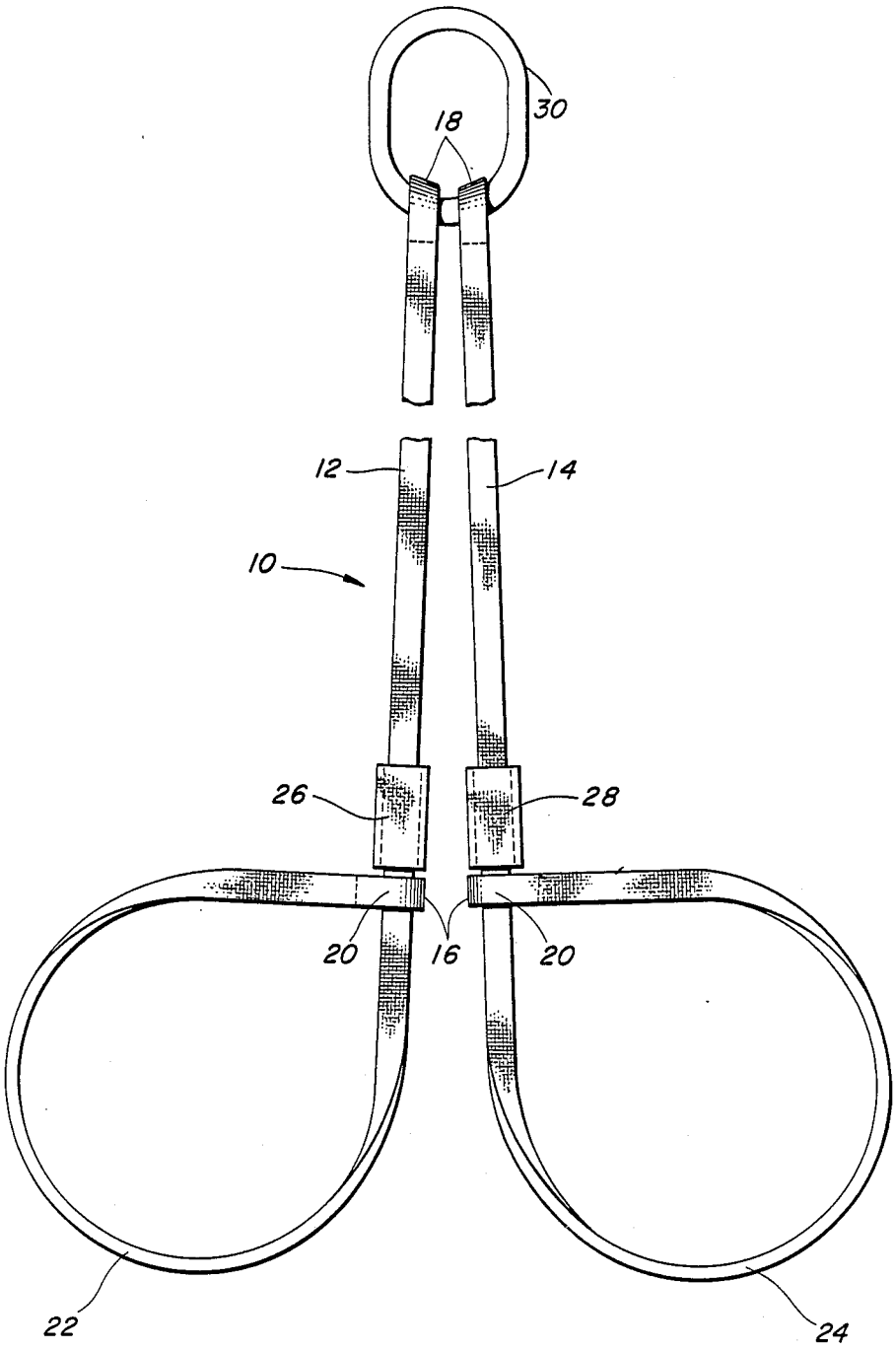
FIG. 2 is an enlarged side elevation showing the sling of the present invention in greater detail.

The sling assembly of the present invention is shown in the figures generally at 10. Sling assembly 10 comprises first strap 12 and second strap 14. Straps 12 and 14 are preferably constructed of high-strength fabric and more preferably of a nylon cloth. Straps 12 and 14 each have a first end 16 and a second end 18. Each first end 16 is formed with an eyelet 20 that is preferably formed by stitching a slidable pocket in the first end, of a size and configuration capable of receiving each second end 18. When second ends 18 have been received in eyelets 20, first loop 22 and second loop 24 are formed in first and second straps 12 and 14, respectively.

Second ends 18 encircle and are stitched around a conventional oval (or circular) ring 30 used to interconnect straps 12 and 14 with the hook 11 of a crane 13 to enable articles to be lifted onto (or from) platform 15 from (or to) the deck of a supply vessel. Ringlets are thereby formed in second ends 18 around ring 30. Slidable sleeves 26 and 28 are positioned on straps 12 and 14 behind lopos 22 and 24. Choker sleeves 26 and 28 enable the workman to position loops 22 and 24 on an article such as an oil drum 19 and then to get closer of the loading zone before any load is taken by the hoisting hook 11. This greatly reduces the risks to the workman that are normally associated with off-loading cargo. Choker sleeves 26 and 28 enable loops 22 and 24 to be tightly engaged about the article to be lifted without risk to its surface finish, no matter how delicate the article may be. Although FIG. 1 shows both straps 12 and 14 engaging a single oil drum 19, in actual practice, each strap 12 and 14 can engage and lift a drum during an individual lifting operation.

These loops 22 and 24, because of the flexibility of the high-strength fabric from which they are constructed, are capable of grippingly engaging a variety of articles without damaging them. For example, even though the sling assembly 10 of the present invention is particularly adapted for handling empty and full oil drums, it is also capable of handling such items as office furniture and glass lighting fixtures without damaging either item. The conventional wire cable and shackles would be incapable of handling such items without some intermediate protective cover, or the like.

The sling assembly 10 of the present invention has been tested for tensile strength up to 1600 pounds without failure but will, preferably, in use be limited to loads up to 500 pounds in order to provide a suitable margin of safety.

Various changes, alternatives and modifications will be apparent to one of ordinary skill in the art following a reading of the foregoing specification. For example, although the eyelets 20 are formed integrally with straps 12 and 14 and choker sleeves 26 and 28 formed separately from eyelets 20, obviously the former could be formed from a separate ring member, for example or, in another laternative, sleeves 26 and 28 could be made an integral part of eyelets 20. Further, although the sling assembly of the present invention is particularly adapted for use loading and unloading a supply vessel for an offshore platform, obviously, the sling of the present invention is suitable for general utility hoisting, as well. Accordingly, it is intended that all such changes, alternatives and modifications as come within the scope of the appended claims be considered part of this invention.

I claim:

1. A sling assembly for use with a crane for lifting and shifting an article or group of articles, said assembly comprising:

(a) a first strap formed of a high strength fabric, said first strap having a first end and a second end;

(b) a second strap formed of a high strength fabric, said second strap having a first end and a second end;

(c) means for interconnecting said first and second fabric straps to a hoisting hook on said crane;

(d) first and second article-encircling loops formed in said first and second straps, respectively, by forming an eyelet in said first end of each strap and passing said second respective end of each strap through said eyelet;

(e) first and second tight fitting choker sleeves engaging said first and second straps, respectively, between said second end and the point at which said eyelet on said first end engages its respective strap, said choker sleeves eaach being slidable along its respective strap to a position immediately adjacent its loop's eyelet to hold said article-encircling loops in engagement with said article.

2. The sling assembly of claim 1 wherein said means for interconnecting said first and second fabric straps comprises at least one ring.

3. The sling assembly of claim 2 wherein said straps each have a ring-encircling ringlet formed in said second end.

4. The sling assembly of claim 3 wherein said ring-encircling ringlet of said first and second straps each engages a single ring.

5. The sling assembly of claim 1 wherein said high-strength fabric comprises a nylon fabric.

6. The sling assembly of claim 1 wherein said tight-fitting choker sleeves comprise separate slidable elements from said eyelets.

7. The sling assembly of claim 1 wherein each said eyelet comprises a sewn pocket which receives its respective second end of said first or second strap.

* * * * *